United States Patent [19]

Colly

[11] 4,076,214

[45] Feb. 28, 1978

[54] DOUBLE-ACTING JACK HAVING A POSITION STOP

[76] Inventor: Pierre Colly, 38, chemin du Grand Bois, Tassin la Demi Lune, Rhone, France

[21] Appl. No.: 752,549

[22] Filed: Dec. 20, 1976

[30] Foreign Application Priority Data

Dec. 24, 1975 France ..... 75 40385

[51] Int. Cl.[2] ..... F15B 9/09

[52] U.S. Cl. ..... 254/93 R; 91/363 R

[58] Field of Search ..... 254/93 R, 93 H; 91/394–396, 363 R, 410; 92/13.4, 13.6, 17

[56] References Cited

U.S. PATENT DOCUMENTS 3,951,042 4/1976 Weiss ..... 91/363 R

*Primary Examiner*—Robert C. Watson

*Attorney, Agent, or Firm*—Browdy and Neimark

[57] ABSTRACT

A double-acting jack having a working chamber is fitted with an adjustable stop against which its piston comes to rest. The stop is constituted by a nonrotatable nut, which is axially displaceable by an axially nondisplaceable lead screw with which it meshes. The stop includes means for controlling the supply of pressurized fluid from a supply line to the working chamber, the supply line being opened whenever the piston and its associated rod are not in the end-of-stroke position and closed whenever the piston and its rod are in the end-of-stroke position. The lead screw is mounted to have a slight amount of axial play. The supply line terminates in an annular opening provided on a shoulder of the lead screw, which defines a valve, or in it seat.

3 Claims, 3 Drawing Figures

DOUBLE-ACTING JACK HAVING A POSITION STOP

BACKGROUND OF THE INVENTION

This invention relates to double-acting jacks of the type which have positive stops and, more particularly, to such jacks having positive stops which are adjustable.

The invention concerns an improvement hydraulic or pneumatic double-acting jacks equipped with adjustable, positive stops, notably of the type described in French Pat. No. 1,128,138. This French patent discloses a double-acting jack associated with an adjustable, positive stop which determines the length of the stroke, and against which the piston can abut. The stop is constituted by a nonrotatable nut, the nut being axially displaceable, by manipulation of a lead screw which is axially immobilized, with which it is in mesh. The lead screw is capable of being set in rotation for the purpose of adjusting the position of the nut.

This type of jack has the advantage of allowing considerable precision in determining the final end-of-stroke position of the piston rod.

However, it is necessary for the lead screw to be able to support the thrust developed by the piston, which, in the case of high-powered jacks, requires the designer to design the jacks to be of considerable size and have components of large dimensions. These known jacks consequently are expensive and cumbersome. Therefore, for a given piston diameter, a specific thrust must not be exceeded, otherwise, the mechanical stresses will exceed the tolerance values for correct fatigue resistance of the adjustable stop and the screw which supports it, as well as additional components, such as the stop ring, holding screw, and others.

SUMMARY OF THE INVENTION

It is the principal object of the present invention to overcome the shortcomings and disadvantages mentioned above.

The aforementioned object, as well as others which are to become evident from the text below, is achieved by an improvement incorporated in jacks of the type described above. According to the present invention, the stop to limit the stroke of the piston is associated with means for controlling the supply of pressurized fluid to the working chamber of the jack, in such manner that this line is open when the fluid is under pressure and by the fact that the piston and its rod are not in the end-of-stroke position, while the latter is closed after having reached this end-of-stroke position.

The improvement makes it possible to increase considerably the pressure in the jack and consequently the thrust of the piston, while reducing the forces supported by the lead screw, the stop nut, and auxiliary members. Conversely, for given thrust forces, it is possible considerably to reduce the dimensions and consequently the space occupied by the individual members and the jacks in their entirety, which considerably reduces the cost.

According to a specific embodiment of the invention, the lead screw is mounted with a slight axial play and, in its position which is situated in the bottom plate of the jack, a shoulder which is turned toward the inside of said jack in positioned to constitute a check valve whose seat is provided in the bottom plate. According to two variants, the supply line for pressurized fluid terminates in either an annular opening provided in the shoulder which forms the check valve of the lead screw or in its seat.

Thus, when the pressurized fluid enters the annular opening, it causes the valve to rise and consequently the lead screw to return, by an amount corresponsing to its axial play. The fluid can then enter the working chamber of the jack and push the piston back to its end-of-stroke position. Before reaching this position, the stop ring on the piston comes to rest against the stop nut and transmits to it the force which it recieves. This force is transmitted by the stop to the lead screw, which is then brought into the position in which it closes the valve. In this position, the feed line for the pressurized fluid is closed in such manner that the lead screw receives only the force created by the pressure of the fluid acting on its shoulder which forms the valve.

DETAILED DESCRIPTION OF THE PREFERRED EMBODIMENT

As mentioned jacks constructed according to the present invention are of the same type described in French Pat. No. 1,128,138, in other words, one equipped with an adjustable stop to limit the stroke.

This type of jack is especially suitable for applications which require a very precise setting of the length of stroke which mere control of the supply of compressed fluid would be unable to provide. This degree of precision is essential, for example, in operating the movable slides of folding presses, which are generally driven by two jacks, each of which acts on one end of said slide.

Hence, it is necessary for the two ends of the punch supported by this slide to enter the same degree into the folding die, failing which the shapes obtained with the aid of this press would not have constant profile.

Figure 1:
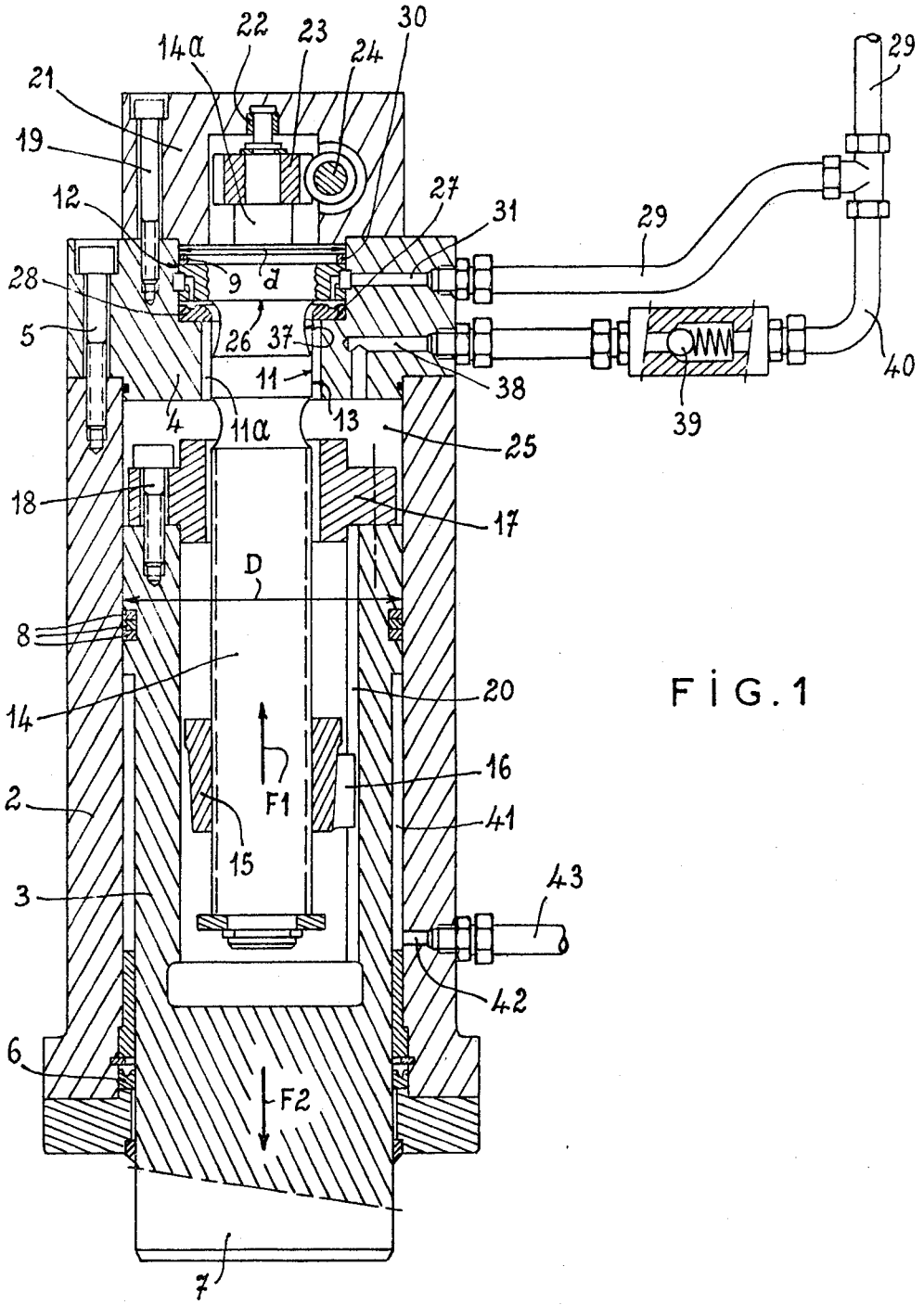
FIG. 1 is an axial cross section of a nonlimitative, embodiment of a double-acting jack according to the present invention.
Figure 2:
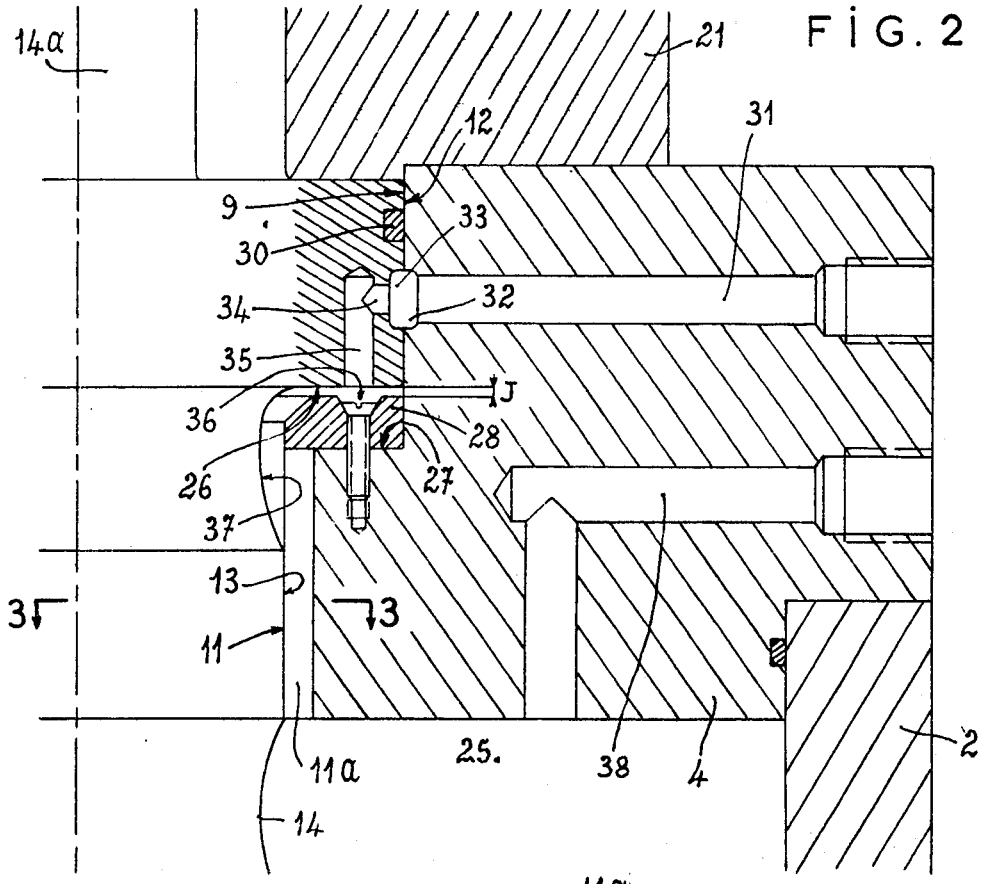
FIG. 2 is a partial cross section similar to FIG. 1 showing on an enlarged scale a detail of the arrangement of a double-acting jack according to the present invention.

For this purpose, the jack described in the above-mentioned French patent is equipped with a stop to limit its stroke. As in this known jack, the embodiment of the jack which is the subject of the present application as shown in FIGS. 1 and 2 includes, a cylinder body 2 having a bore D, wherein a hollow cylindrical piston 3 moves, the piston having a corresponding diameter. One end of the cylindrical body 2 is closed by a bottom plate 4, attached to it by screws 5.

The sealing between the body 2 and the piston 3 is provided, on the one hand, with a seal 6 which is supported by the body 3 in the vicinity of its open end, traversed by a rod 7 of the piston 3, and on the other hand by rings 8 supported by the piston 3.

In the center of the base plate 4 of the body 2 there are two coaxial bores, an outer bore 9 with diameter *d* and an inner bore 11 with a smaller diameter. These bores 9 and 11 are intended to serve as supports for cylinderical faces, 12 and 13 respectively, of the smooth end of a threaded rod 14, whose free end opposite the faces 12 and 13 meshes with the opening in the piston 3, the rod serving as a lead screw with a nut 15 that meshes with it.

A nut 15 is prevented from rotating by engaging a projection 16 provided on its lateral face in a longitudinal opening 20, provided to receive it, along the inside wall of the piston 3.

Finally, the open end of the piston 3 is partially closed by a stop ring 17 attached to it by screws 18 and intended to abut the corresponding face of the nut 15 to cause the piston 3 to stop moving.

Finally, on the base plate 4 of the body 2, by means of screw 19, a casing 21 is fastened wherein a bearing 22 is provided, intended to receive the end of an extension 14*a*, of the lead screw 14 and to receive a gear 23 which is mounted on this extension and meshes with a worm 24 which serves to set it rotating and consequently to cause the lead screw 14 to rotate.

It is readily apparent that by means of the system as thus far described, which corresponds to the one described in the above-mentioned French patent, it is possible to adjust the position of the stop nut 15 along the lead screw 14 and to adjust at will the end-of-stroke position of the piston 3.

It is readily apparent that at the end of the stroke, the thrust exerted by the pressurized fluid which supplies a working chamber 25 of the jack illustrated in FIG. 1, must be supported by the nut 15, the lead screw 14, the stop ring 17, and its holding screws 18, without generating mechanical stresses in excess of the valves tolerated by these various components.

As pointed out above, for a given diameter D of the piston 3 or of the cylindrical body 2, it is not possible to exceed a predetermined fluid pressure because of the mechanical strength and resistance characteristics of these components.

The aim of the present invention is therefore to overcome this disadvantage by limiting the force which these components must withstand to a magnetude smaller than the thrust of the jack and even, to some degree, independent of the thrust.

For this purpose, as can be most easily seen from FIG. 2, the lead screw 14 has been mounted in the closing plate 4 of the body 2 with an axial play J. In addition, it is for the same reason that the two faces 12 and 13 of different diameters have been provided on the ends of the lead screw 14.

This difference in diameter creates a shoulder 26 which is directed toward the interior of the body 2 and, conversely, the difference between the bores in closing plate 4 creates a corresponding shoulder 27. The shoulder 26 of the lead screw 14 forms a valve which controls the supply or pressurized fluid to the working chamber 25; the seat of the valve is constituted by a ring 28 mounted on the soulder 27 provided in the closing plate 4.

A feed line 29 for the pressurized fluid is connected to channels 31 located radially in the closing plate 4 at the level of the bearing 9 and terminating in an annular opening 32 provided in the bearing, matching an annular opening 33 provided in the face 12. The opening 33 communicates by radial channels 34 with longitudinal channels 35 opening into the shoulder 26 at right angles to an opening 36 provided in the surface of the seat 28 opposite the shoulder 26.

An annular sealing ring or joint 30 insures a tight seal between the bearing 9 and the face 12.

Figure 3:
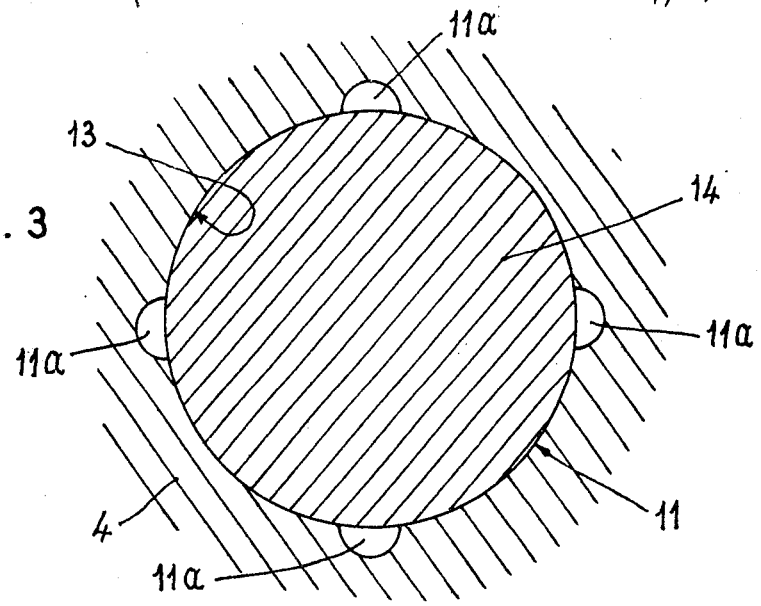
FIG. 3 is an axial cross section taken along section line 3—3 in FIG. 2.

In addition, as shown most clearly in FIG. 3, the bore 11 which serves to support the face 13 of the lead screw 14 is provided with longitudinal openings 11*a*.

Finally, in that portion which is located between the faces 12 and 13, the lead screw 14 is provided with cutout 37 which allows the pressureized fluid to move from the opening 36 into the openings 11*a* and thus to reach the working chamber 25, while the valve formed by the shoulder 26 is in the raised position, i.e., open, as illustrated.

Closing plate 4 also is provided with another channel 38 which opens directly into the working chamber 25 of the cylindrical body 2 and is connected by a check valve 39 and a line 40 to the feed line 29 for supplying pressurized fluid.

In addition, an annular chamber 41 provided between the piston 3 and the cylindrical body 2, between seal 6 and the shoulder of the piston supporting the rings 8, communicates via a radial channel 42 with a line 43 for supplying pressurized fluid, connected, like feed line 29, to the regulator for the jack.

It is therefore obvious that when the jack is not supplied with pressurized fluid and is in a vertical position with its sealing plate 4 in its upper position, the weight of the lead screw 14 and the stop nut 15 tends to keep them in the bottom position, in other words, with the valve formed by the shoulder 26 resting on its seat 28, which keeps the supply line for pressurized fluid shut off.

An increase in the pressure of the fluid up to the annular opening 36 causes the valve 26 to rise and consequently causes the lead screw 14 and its stop nut 15 to rise as well.

The pressurized fluid can thus flow into the working chamber 25 of the jack.

The force which is thus exerted in the direction of arrow F1 on the lead screw 14 is equal to the pressure of the fluid multiplied by the cross section of the valve 26, in other words, by the area of a circle having a diameter *d*.

The force which is capable of acting on the piston 3 in the direction of arrow F2, in other words the maximum resistance which the piston 3 is capable of overcoming, is equal to the pressure of the fluid multiplied by the cross section of the piston, in other words by the area of a circle having a diameter D.

When, as a result of the advance of the piston 3 in the direction of the arrow F2, the front face of the stop ring 17 comes to rest against the rear face of the stop nut 15, the piston 3 trains the stop nut 15 and consequently moves the lead screw 14, with which it is integral, in the same direction. Since the force with which the piston 3 is capable of acting is greater than that required for lifting the lead screw 14 and consequesntly for opening the valve 26, it is clear that if the resistance is greater than the difference between these two forces, the piston 3 will drive the screw 14 in the direction of the arrow F2 until the valve 26 closes, in other words, for a distance corresponding to the play J.

The force supported by the lead screw 14 and its associated components, that is, the nut 15, the stop ring 17 and the holding screws 18 will consequently be equal to the force required for raising the valve 26 and never greater than this force.

When the valve 26 is brought into the closed position by the piston 3, the supply line for the pressurized fluid to the working chamber 25 is closed and the pressure inside this chamber falls at once.

The forces acting on the lead screw 14 and its aforementioned associated components are therefore not related to the cross section of the cylinder, but only to the cross section of the valve 26 in such manner that it is possible to increase the cross section of the cylinder without it being necessary to increase, at the same time, the cross section of the lead screw 14 and the dimensions of its above-mentioned associated components.

The piston 3 can be made to return, as in classical double-acting jacks, by returning the pressurized fluid through the line 43 into the annular chamber 41, and the fluid that has been introduced previously into the chanmber 25 is discharged via the channel 38 and the check valve 39.

It is thus possible considerably to reduce the dimensions and consequently the space occupied and the cost of high-powered jacks.

The check valve 39 prevents the direct passage of the pressurized fluid into the chamber 25 via the line 40 during the operating phase of the jack.

A jack constructed according to the present invention can advantageously be operatively associated with folding presses and the like to great advantage in this type of machine breakage of a stroke-limiting stop on one of the heretofore used conventional jacks driving the movable slide could result, not only in damage to the punch and die, but also to the uprights of the press.

As follows from the above, the invention is not limited only to the embodiment of the jack described hereinabove as a nonlimitative example; on the contrary, it encompasses all embodiments. Thus, for example, in the embodiment described above, the control elements are provided above the closing plate 4, but it would be possible to provide them between the valve 26 and the working chamber 25. Numerous other embodiments and variants are possible within the sprit and scope of the invention, its scope being defined in the appended claims.

I claim:

1. In a double-acting jack fitted with an adjustable positive mechanical stop, against which its piston comes to rest and having a working chamber, the positive mechanical stop being constituted by a nonrotatable nut, the nut being axially displaceable by an axially nondisplaceable lead screw with which it meshes, and the screw being capable of being set in rotation for the purpose of adjusting the position of the nut, the improvement wherein said positive mechanical stop which limits the stroke of said piston includes means for controlling the supply of pressurized fluid from a supply line to said working chamber of the jack by opening the supply line to said working chamber when the fluid is pressurized and said piston and said rod are not at a given end-of-stroke position and by closing the supply line to said chamber as soon as said piston and said rod reach the end-of-stroke position.

2. An improved double-acting jack according to claim 1, including a bottom plate and wherein said lead screw is mounted with a slight amount of axial play, a portion of said screw being located on said bottom plate of the jack and being provided with a shoulder, said shoulder being turned toward the inside of the jack and constituting a check valve whose seat is located in said plate, said supply line for the pressurized fluid terminating in an annular opening provided in said shoulder forming the valve of said lead screw.

3. An improved double-acting jack according to claim 1, including a bottom plate and wherein said lead screw is mounted with a slight amount of axial play, a portion of said screw being located on said bottom plate of the jack and being provided with a shoulder, said shoulder being turned toward the inside of the jack and constituting a check valve whose seat is located in said plate, said supply line for the pressurized fluid terminating in said seat.

* * * * *